US006079666A

United States Patent [19]

Hornback

[11] Patent Number: 6,079,666

[45] Date of Patent: Jun. 27, 2000

[54] REAL TIME BORESIGHT ERROR SLOPE SENSOR

[76] Inventor: Alton B. Hornback, 5650 Bloch St., San Diego, Calif. 92122

[21] Appl. No.: 06/859,033

[22] Filed: Apr. 25, 1986

[51] Int. Cl.[7] ..... F41G 7/00

[52] U.S. Cl. ..... 244/3.19; 244/3.16; 244/3.15

[58] Field of Search ..... 244/3.19, 3.15, 244/3.16

[56] References Cited

U.S. PATENT DOCUMENTS 4,303,211 12/1981 Dooley et al. ..... 244/3.19

OTHER PUBLICATIONS

Waymeyer, W. K. and Macala, G. A., "Intercept Guidance and Control Concepts Demonstration", AFATL–TR–79–59, pp. 74–79, Feb. 1978.

Yost, D. J., Weckesser, L. B. and Mallalieu, R. C., "Technology Survey of Radomes for Anti–Air Homing Missiles", FS–80–022, Johns Hopkins University Applied Physics Laboratory, Mar. 1980.

*Primary Examiner*—Charles T. Jordan
*Assistant Examiner*—Theresa M. Wesson

[57] ABSTRACT

In a missile which employs a terminal homing seeker and a proportional navigation guidance law the space rate of change of boresight error, i.e., the boresight error slope, is one of the predominant error sources.

It has been found that the boresight error slope is proportional to the curvature of the seeker open loop transfer characteristic. Accordingly, the boresight error slope sensor senses the curvature of the seeker open loop transfer characteristic. This is accomplished by intermittently dithering the seeker instantaneous field-of-view about the line of sight at a rate too great for the normal tracking loop to respond. Thus the open loop transfer characteristic is obtained while leaving the normal tracking loop unperturbed. The curvature of the open loop transfer characteristic is then obtained in real time by computing the "second differences" from the measured open loop transfer characteristic.

4 Claims, 3 Drawing Sheets

Boresight Error Slope Sensor

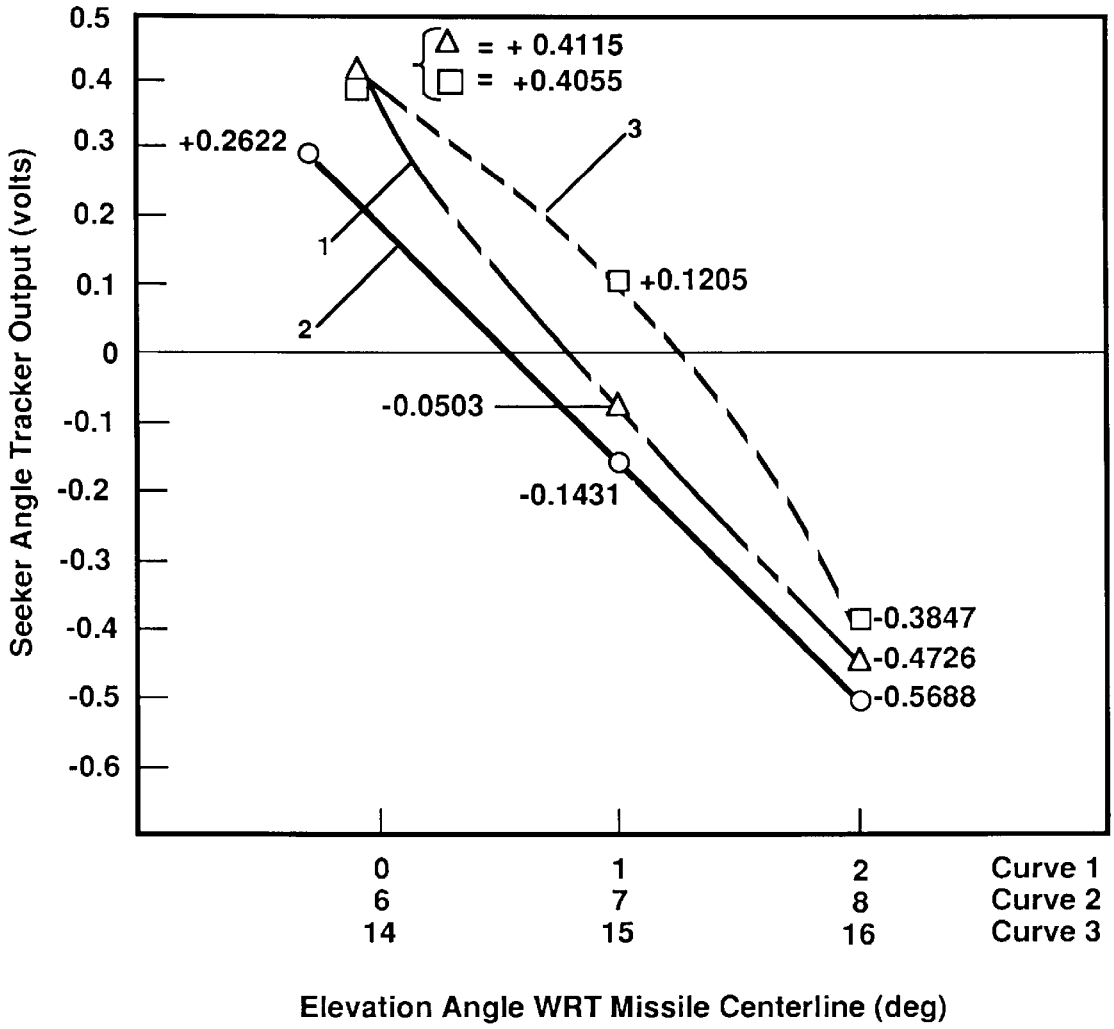
Figure 1. Transfer Characteristics

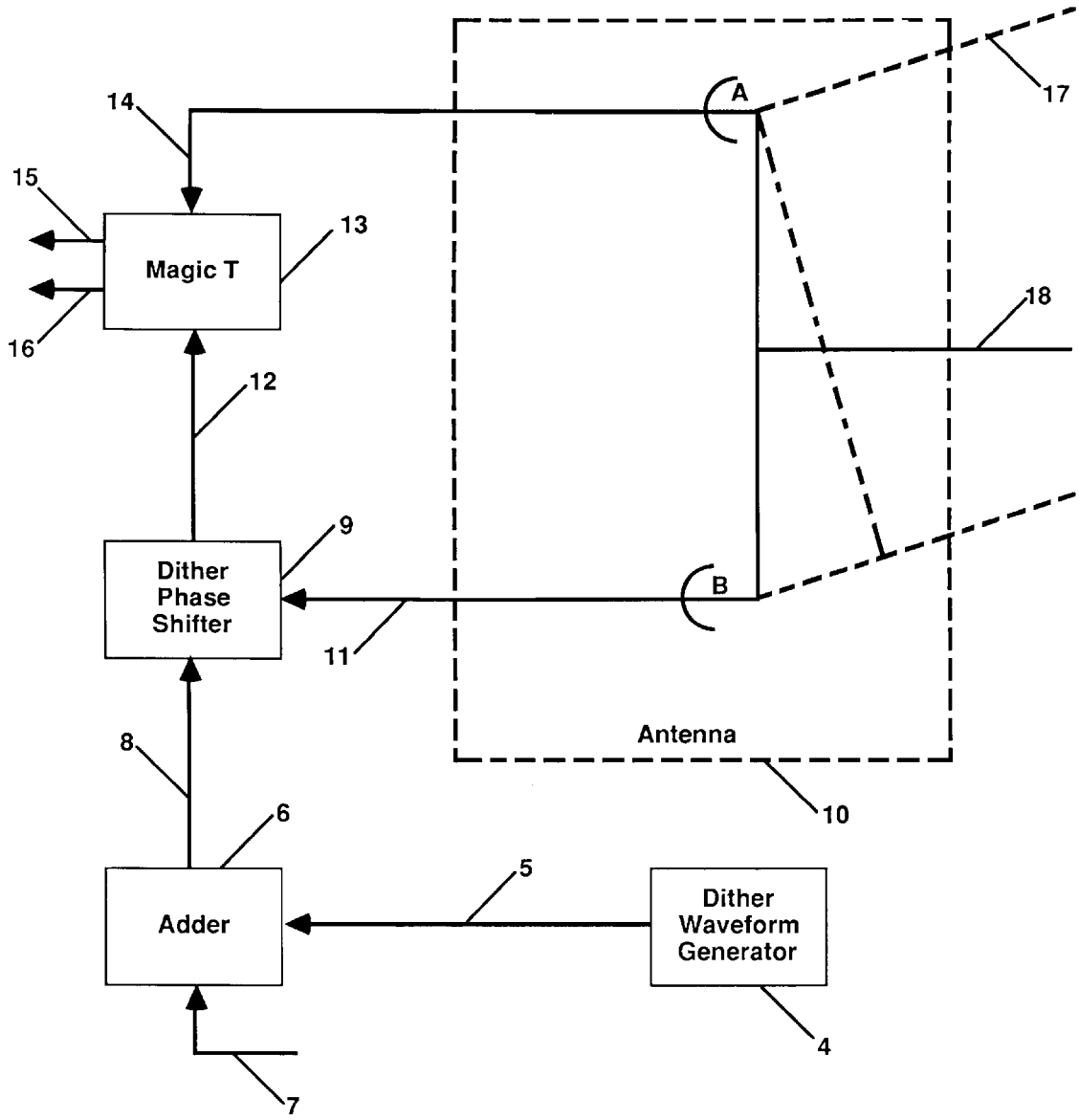
Figure 2. Beam Dither Generator

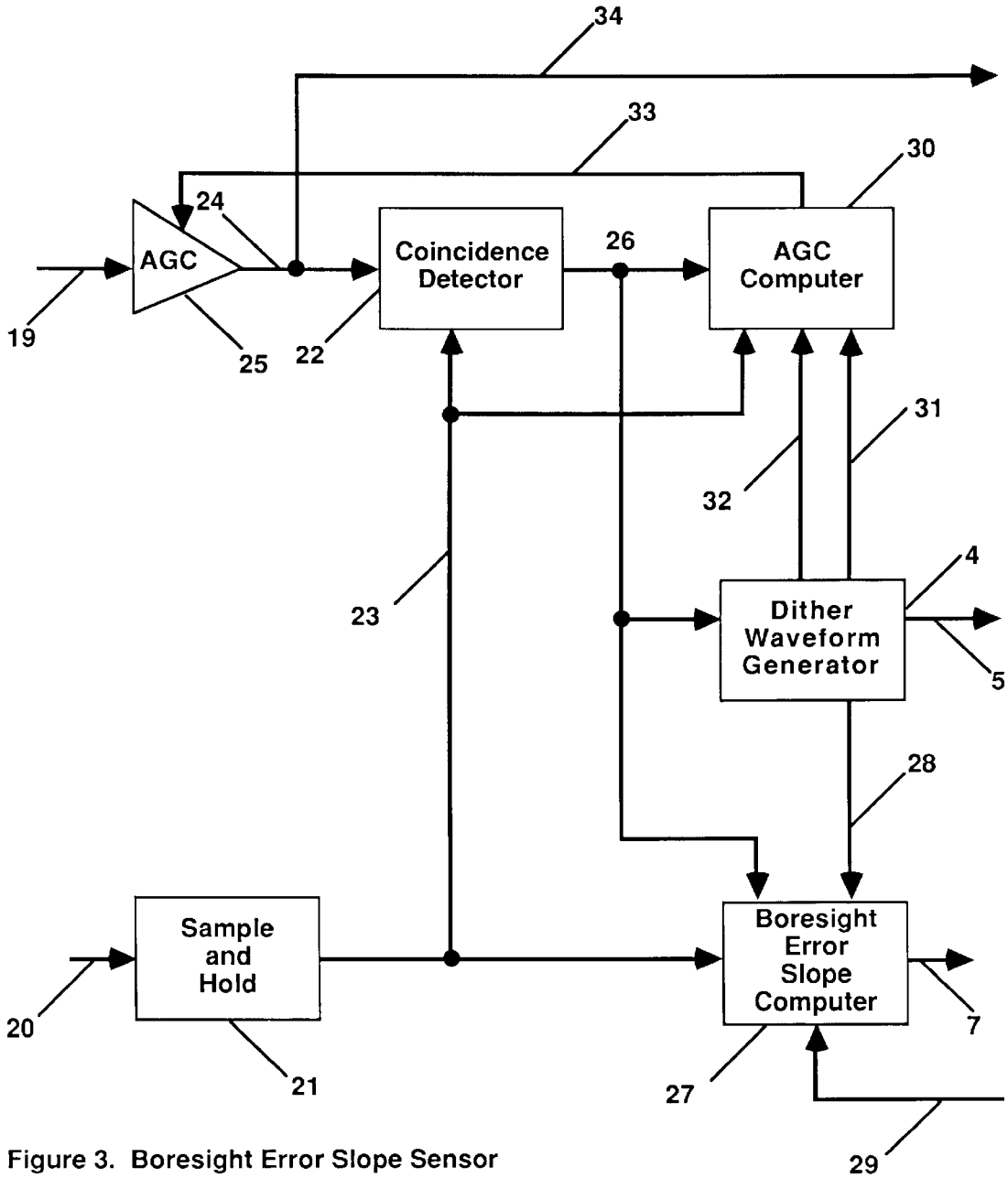
Figure 3. Boresight Error Slope Sensor

REAL TIME BORESIGHT ERROR SLOPE SENSOR

1.0 BACKGROUND

1.1 Field of the Invention

This invention is in the field of missile guidance and relates to a device which senses, in real time, the boresight error slope.

1.2 The Prior Art

In a missile which employs a terminal homing seeker and a proportional navigation guidance law, the space rate of change of boresight error, i.e., the boresight error slope, is one of the predominant error sources. This slope is defined as a small change in boresight error divided by a small change in aspect angle. With a proportional navigation guidance law, it is required that the line-of sight (LOS) to the target not rotate in inertial space. Thus an error in line-of sight rate rather than an error in LOS angle, per se, is the predominamt error. When the boresight error slope (denoted by m) is multiplied by body rate (denoted by $\dot{\theta}$) an error in LOS rate (denoted by $\Delta\dot{\beta}$) is produced. Since $\Delta\dot{\beta}$ is in a parasitic loop from body rate to apparent target motion, through the guidance gain, and back to body rate it can cause erratic instabilities.

Various approaches have been used to minimize either the boresight error slope or its effect on missile guidance. These include:

a. Reducing guidance loop gain or increasing guidance time constant. This compromises guidance accuracy.

b. Controlling radome wall thickness during the fabrication process by machine grinding or forming. This is expensive, time consuming, and usually yields a boresight error slope greater than about 0.06 degrees per degree.

c. Preflight mapping the boresight errors, storing these errors in a look-up table and actively compensating for the errors during flight. Although residual errors after compensation have been measured as low as 0.01 deg/deg this is very expensive since each radome must be individually mapped. Also, this does not compensate for inflight variation of errors.

d. Opening the guidance loop and introducing a known dither, in both pitch and yaw, of the body axis about the velocity vector while the seeker is still tracking the target. The measured LOS rate is then compared with that expected from the known dither rate to obtain the LOS rate error. This technique may introduce oscillation into an otherwise marginally stable missile. It takes considerable time and energy because of the two-axis dither. The dither is necessarily slow because of missile response time; therefore the data may not be in real time for hypersonic flight where the radome statistics are changing rapidly. This method has never been tested.

It has been found that for supersonic flight at high altitude with low aerodynamic q, a boresight error slope (m)<0.01 deg/deg is required to prevent the parasitic loop from causing the missile to go unstable. Thus the foregoing approaches to reducing m may not be satisfactory.

2.0 OBJECTS AND ADVANTAGES

The real time boresight error slope sensor described herein is an inexpensive device capable of reducing the line-of-sight rate errors contributed by the radome or IR dome in real time from whatever the cause. The various sources of nonzero m include those arising from aerodynamic heating from supersonic or hypersonic flight such as ablation, plasma, char and erosion, as well as those from external sources such as frequency agility or irradation by a high energy laser. This is accomplished in real time which is necessary if the dome statistic are time varying.

3.0 DRAWING FIGURES

FIG. 1 shows the nonlinearity of three characteristic curves for three different look angles.

FIG. 2 is a functional block diagram of the antenna beam dither generator.

FIG. 3 is a functional block diagram of the boresight error slope sensor with a scale factor (AGC) correction loop.

4.0 PHYSICAL PRINCIPLE

During a research program to employ a microwave RF (radio frequency) seeker in a hypersonic missile, this inventor discovered that the curvature of the seeker open loop transfer characteristic (i.e. output voltage vs. look angle measured from electrical boresight) was proportional to the boresight error slope. The pertinent results of this research are shown in FIG. 1. Curve 1 shows that the transfer characteristic is slightly curved upward (concave) at a look angle of 1 deg off the nose where the boresight error slope m, was found to be +0.05 deg/deg. Curve 2 shows that the transfer characteristic is a straight line at an LOS=7 deg where m=0. Curve 3 shows that the transfer characteristic is dramatically curved downward (convex) at 15 deg where m=−0.12 deg/deg.

Although the research was performed at RF it is reasonable to assume that the relationship between boresight error slope and transfer characteristic nonlinearity is not frequency dependent. Accordingly the physical principle of this invention applies to infra-red (IR) as well as RF seekers. However, only the boresight error slope of an RF seeker with a gimballed phase monopulse antenna or a phase interferometer will be described.

If the antenna beam is caused to dither intermittently at a rate too great for the tracking loop to respond, then the seeker tracking loop is open insofar as the dither is concerned. However the normal tracking loop is left unperturbed. The real time sensed seeker output voltage vs. look angle TCR can then be determined, without interfering with normal tracking.

There are three properties of the transfer characteristic which are pertinent to this patent. First the transfer characteristic (TC) may be a straight line with any slope (not to be confused with boresight error slope) but with the null shifted away from antenna array normal. The amount the electrical null is shifted from array normal is the boresight error and can not be sensed by the device described herein. Second the slope of the TC is a measure of tracking loop gain and is sensed in this device. Third, the nonlinearity of the TC in the neighborhood of the LOS is a measure of the boresight error slope. This is also sensed by this device and is the key to this invention. The magnitude and sense of the boresight error slope are proportional to the magnitude and sense respectively of the transfer characteristic nonlinearity in the neighborhood of the line of sight.

5.0 FUNCTIONAL DESCRIPTION

Two identical channels (pitch and yaw) are required. Only the pitch channel will be described.

5.1 Beam Dither Generator

Refer to FIG. 2. A pulsed sawtooth dither waveform generator 4 generates a sawtooth voltage waveform $V_D(t)$ with the following parameters:

| | | |
|---|---|---|
| (a) | Duty Factor: | $\overline{DF} = 0.1$ |
| (b) | Pulse repetition frequency: | $PRF = 100\,\text{pps}$ |
| (c) | Pulse duration: | $\tau = 1\,\text{ms.}$ |
| (e) | Sawtooth frequency | $f_C = 10\,\text{KHz}$ |
| (f) | Pulse repetition interval | $T = \frac{1}{PRF} = 0.01\,\text{sec}$ |

Values of the foregoing parameters can be justified for the following reasons:

a. Duty Factor: A dither duty factor ($\overline{DF}$) no greater than about 10% is required so that no perturbation exists for approximately 90% of the time, thus leaving the normal tracking loop virtually unperturbed.

b. PRF: A PRF much greater than the normal tracking loop bandwidth, typically 5 to 10 Hz, is required, again so that the normal tracking loop cannot respond to the perturbations. Thus, a dither PRF=100 pps appears reasonable.

c. Pulsewidth: The pulsewidth from items a and b is $$\tau = \frac{\overline{DF}}{PRF} = 1.0\text{ ms.}$$

d. Carrier Frequency: Approximately 10 cycles are desired in order to yield good average values when the result is averaged over one pulsewidth. Thus, a dither carrier frequency of $$f_c = \frac{N}{\tau} = \frac{10}{1\times10^{-3}} = 10\text{ KHz}$$

appears reasonable.

e Amplitude: The peak value of the waveform is chosen to shift the beam±0.5 beamwidths about the nominal electrical boresight axis.

The output voltage $V_D(t)$ from the dither waveform generator (4) is coupled to an adder 6 via a shielded conductor 5. This voltage is added to $V_m$ which is coupled to the adder 6 on a shielded conductor 7 from the boresight error slope computer 27, described later. The sum $V_S(t)$ is applied to the dither phase shifter 9 via a shielded conductor 8. The dither phase shifter 9 can be either an analog phase shifter (ferrite) or digital (PIN diodes). An analog phase shifter is used here. The dither phase shifter 9 is in one arm B of a phase monopulse antenna 10. RF is fed from subarray B of antenna 10 to the dither phase shifter 9 via waveguide 11. The output of the dither phase shifter 9 is coupled to the magic T 13 via waveguide 12. RF from subarray A of antenna 10 is fed to the magic T 13 on waveguide 14.

The magic T 13 forms the complex sum, (Σ), and complex difference, (Δ), of the two RF voltages on waveguide 12 and 14. These are fed to the Σ and Δ mixers (not shown) on waveguides 15 and 16 respectively where they are converted to ΣIF and ΔIF, respectively.

The antenna beam center 17 is caused to dither with respect to array normal 18 in accordance with the sawtooth waveform $V_D(t)$.

It is inertialess scanning and can be as rapid as we please, even 10,000 times per second ($f_c$=10 KHz).

5.2 Boresight Error Slope Sensor

The boresight error slope sensor is implemented as two feedback loops. The first is the boresight error slope correction loop. It is a phase correction loop with the dither phase shifter 9 (FIG. 2) as the follow-up device since the antenna is a phase monopulse antenna. If the seeker were an IR sensor, the boresight error slope correction could be implemented with an open loop computation. The second loop is an AGC (automatic gain control) loop to correct for scale factor error.

Refer to FIG. 3. The boresight error slope sensor requires two inputs from the seeker receiver. The first is the antenna servo output usually low-pass filtered to about 10 Hz. This is denoted by ϵ(t) and is a voltage proportional to the angle of the LOS from electrical boresight. It is sometimes called the dynamic lag. ϵ(t) is coupled to the boresight error slope sensor on a shielded conductor 19. The second input is the video from the ratio detector which forms the ratio Re $$\left[\frac{\Delta}{\Sigma}\right].$$

The video is usually pulses for a pulsed radar, although other types of wide bandwidth signals such as those received from passive IR or cw jammers, may be accepted. This wide band video is coupled to the boresight error slope sensor via coax cable 20.

(a) Boresight Error Slope Correction Loop

If the LOS is at electrical boresight the receiver difference channel IF, (i.e. ΔIF) is zero and the voltage on coax 20 is zero. If the LOS is within the Σ beamwidth (i.e. FOV) but not at boresight the ratio detector output on coax 20 is proportional to the LOS angle off boresight. This differs from ϵ(t) on 19 in that ϵ(t) is low pass filtered to about 10 Hz whereas Re $$\left[\frac{\Delta}{\Sigma}\right]$$

on 20 is wide band video (of the order of a few MHz).

The received video on coax 20 and the dynamic lag ϵ(t) on shielded cable 19 are processed in a signal processor comprised of the sample-and-hold circuit 21 and a coincidence detector 22. For a pulsed radar there must be at least one sample per pulse. Alternatively, the sampling rate (Nyguist Sampling Theorem) must be at least twice the information bandwidth, or two samples per cycle of information. This sample is held for the received pulse repetition interval. The sample rate and the hold period are set by the associated radar parameters. With the sample rate and the hold duration properly chosen and the beam dithering, the output voltage on conductor 23 is a time varying voltage denoted by $V_{DR}(t)$, the instantaneous value of which is proportional to the angle between the Δ pattern beam null and the LOS. $V_{DR}(t)$ is compared in the coincidence detector 22 with the lag voltage Kϵ(t) on conductor 24. K is the gain of the AGC amplifier 25. At the instant $V_{DR}(t)$=K ϵ(t) the output of the coincidence detector on conductor 26 is a delta function or unit impulse δ(LOS). The time of occurance of 6(LOS) is the time the signal $V_{DR}(t)$ received as a result of the rapid antenna beam dither (open loop) equals the low pass filtered voltage Kϵ(t) of the tracking loop (closed loop).

The unit impulse δ(LOS) on conductor 26 is fed to the boresight error slope computer 27 along with the voltage $V_{DR}(t)$ on conductor 23 from the sample-and-hold 21. Recall that $V_{DR}(t)$ is the rapidly time varying received voltage resulting from antenna dither. This voltage $V_{DR}(t)$ is sampled in the boresight error slope computer 27 by the unit impulse δ(LOS) to yield a voltage $V_{DR}$(LOS). This is the value of the voltage $V_{DR}(t)$ at the instant the antenna beam or field-of-view is at the position it would be if the beam were not dithering and the tracking loop were closed. In other words the value of the transfer characteristic at the LOS has been obtained, and without disturbing the tracking loop.

Now the value of the transfer characteristic a small angle either side of LOS is desired. This is obtained from a unit impulse occuring at LOS±Δt from the clock in the dither waveform generator 4 and coupled to the boresight error slope computer 27 via conductor 28. Note that the unit impulse δ(LOS) on conductor 26 is also fed to the dither waveform generator 4. Thus a small increment of time Δt is added to or subtracted from the time of occurance of δ(LOS) to yield δ(LOSγΔθ). This holds since the dither waveform is a sawtooth, hence the angular excursions of the antenna beam or field of-view are linear functions of time. Therefore a voltage $V_{DR}$(LOS±Δθ) is generated by sampling $V_{DR}$(t) with the delta function δ(LOS±Δθ). In other words the value of the transfer characteristic at LOS±Δθ in the neighborhood of the line of sight has been obtained. A boresight error slope correction voltage $V_m$ is now formed in the boresight error slope computer 27 from the relation $$V_m[V_{DR}(LOS+\Delta\theta)-V_{DR}(LOS)]-[V_{DR}(LOS)-V_{DR}(LOS\Delta\theta)]$$

Notice that if the transfer characteristic is a straight line, the two terms in brackets are equal and $V_m$=0. Thus this "second difference" method yields a correction voltage $V_m$ proportional to the nonlinearity of the transfer characteristic. And this was shown in FIG. 1 and Section 4.0 to be proportional to the boresight error slope. $V_m$ is fed to the adder 6, FIG. 2, via shielded cable 7. A voltage proportional to body rate $\dot{\theta}$ is fed to the boresight error slope computer 27 on shielded cable 29 to determine the sense of $V_m$. The boresight error slope correction loop is now complete.

(b) AGC Loop (Scale Factor Correction Loop)

An automatic gain control (AGC) or scale factor correction voltage is generated in the AGC computer 30 in much the same manner as the boresight error slope correction voltage $V_m$ was generated.

The voltage $V_{DR}$(t), the instantaneous value of which is proportional to the angle of the Δ null from LOS, is fed to the AGC computer 30 from the sample-and-hold 21 via conductor 23. Also fed to the AGC computer 30 is the unit impulse δ(LOS) from the coincidence detector 22 via conductor 26. δ(LOS) samples $V_{DR}$(t) to form a voltage $V_{DR}$ (LOS) just as was done in the boresight error slope computer. Now the value of the transfer characteristic a small angle either side of LOS $V_{DR}$(LOS±Δθ) is also generated in the AGC computer 30 by sampling $V_{DR}$(t) by a delta function δ(LOSγΔθ) fed to the AGC computer 30 from the dither waveform generator 4 via conductor 31 just as was done in the boresight error slope computer. In fact the voltage $V_{DR}$(LOS) and $V_{DR}$(LOS±Δθ) generated in the boresight error slope computer 27 could be used in the AGC computer 30.

Here the similarity ends. The AGC loop depends upon the difference between the voltages from the actual received transfer characteristic TCR and the corresponding voltages from the ideal transfer characteristic TCA. Since the dither driving function is a sawtooth, the instantaneous angle of the antenna A pattern from the array normal is linearly proportional to the dither voltage $V_D$(t). Accordingly the dither voltage $V_D$(t), coupled to the AGC computer via conductor 32, is sampled by δ(LOS) and δ(LOSγΔθ) to yield $V_D$(LOS) and $V_D$(LOSγΔθ) respectively from the ideal transfer characteristic. An AGC correction voltage $V_{AGC}$ is then generated from the relation.

$$V_{AGC}[V_{DR}(LOS+\Delta\theta)-V_{DR}(LOS)]-[V_D(LOS\pm\Delta\theta)-V_D(LOS)]$$

If the two voltages in brackes are equal, the AGC voltage is zero and the open loop transfer characteristic TCR coincides with the ideal transfer characteristic TCA. The AGC voltage $V_{AGC}$ is applied to the AGC amplifier 25 via conductor 33 to control the gain of the AGC amplifier 25, thereby yielding a better estimate of ϵ(t) on conductor 24 than would otherwise be available. The output of the AGC amplifier 25 is fed to the autopilot via conductor 34.

6.0 CONCLUSION

It is concluded that the REAL TIME BORESIGHT ERROR SLOPE SENSOR described herein can sense and reduce the boresight error slope in real time from whatever the cause of nonzero slope. These include high temperature gradients from aerodynamic heating, frequency agility, ablation, plasma, char, erosion, and irradiation by a high energy laser.

Since the boresight error slope is sensed by measuring the curvature of the seeker open loop transfer characteristic, the technique is independent of carrier frequency. Accordingly this patent applies to infra-red (IR) seekers as well as radio frequency (RF) seekers.

GLOSSARY (U)

LOS Line of sight m boresight error slope $\dot{\theta}$ body rate $\Delta\dot{\theta}$ error in line-of-sight rate RF Radio frequency IR Infra-red TC Transfer characteristic (seeker output voltage vs look angle relative to electrical null TCR Received transfer characteristic TCI Ideal transfer characteristic $\overline{DF}$ Duty factor PRF Pulse repetition frequency T Pulse duration $f_c$ Sawtooth frequency T Pulse repetition interval $$T = \frac{1}{PRF}$$

N Number of cycles $f_c$ during τ, (N=$f_c$τ)

$V_D$(t) Voltage output of dither waveform generator $V_m$ Voltage output of m computer $V_S$(t) $V_D$(t)+$V_m$ ϵ(t) Antenna servo dynamic lag

RE $$\left[\frac{\Delta}{\Sigma}\right]$$

Ratio detector output

Σ Antenna sum pattern or sum voltage

Δ Antenna difference pattern or Δ voltage $V_{DR}$(t) Voltage output of sample and hold δ(χ) Unit impulse occuring at χ t running time

Δt small increment in time $V_m$ Voltage proportional to boresight error slope $V_{AGC}$ Voltage proportional to difference in slope of ideal transfer characteristic and measured transfer characteristic

I claim:

1. A boresight error slope reduction system for sensing, in real time, a boresight error slope in a homing seeker, said system comprising:

(a) a seeker having a steerable field-of-view, said field-of-view having an electrical boresight axis, and (b) a receiver wherein a wide bandwidth video signal voltage is obtained when an object is within said field-of-view, said object being on a line-of-sight from said seeker causing an included angle between said line-of-sight and said boresight axis, said video signal voltage being a function of said included angle, and (c) a tracking loop having a means for using said signal voltage to steer said field-of-view so that said object remains within said field-of-view and a means for generating a low-pass filtered dynamic lag voltage from said video signal voltage, and (d) a dither waveform generator wherein a dither voltage is generated and (e) a means for using said dither voltage to cause a dither of said boresight axis and (f) a means for causing said tracking loop to be open during said dither of said boresight axis and (g) a boresight error slope computer circuit for generating a transfer characteristic having a measurable curvature, said transfer characteristic being a voltage functionally related to said included angle, said angle resulting from said dither, and (h) a boresight error slope computer circuit for generating a correction voltage, said correction voltage being a function of said curvature of said transfer characteristic in a neighborhood of said line of sight, and (i) an additive means for using said correction voltage to reduce said boresight error slope.

2. The boresight error slope reduction system of claim 1 wherein said tracking loop includes an automatic gain control amplifier and an automatic gain control computer, said automatic gain control computer comprising:

(a) a transfer characteristic sample-and-hold circuit for obtaining two samples of said transfer characteristic, a first sample being obtained at a first instant, said first instant being the instant of coincidence between said wide bandwidth video signal voltage and said low-pass filtered dynamic lag voltage, and a second sample being obtained at a second instant, said second instant being at a different time from said first instant, and (b) a signal subtracter circuit for generating a direct current signal voltage by subtracting said first sample of said transfer characteristic from said second sample of said transfer characteristic and (c) a dither sample-and-hold circuit for obtaining two samples of said dither voltage, a first sample of said dither voltage being obtained at said first instant and a second sample of said dither voltage being obtained at said second instant, and (d) a dither subtracter circuit for generating a direct current reference voltage by subtracting said first sample of said dither voltage from said second sample of said dither voltage and (e) an automatic gain control subtracter circuit for generating an automatic gain control voltage by subtracting said direct current reference voltage from said direct current signal voltage and (f) a means for applying said automatic gain control voltage to said automatic gain control amplifier.

3. The boresight error slope reduction system of claim 1 wherein said seeker is a radio frequency seeker having a phase sensing monopulse antenna and said additive means is a phase shifter.

4. The boresight error slope reduction system of claim 1 wherein said seeker is an infra-red seeker and said additive means is an adder circuit for adding said correction voltage to said dynamic lag voltage.

* * * * *

UNITED STATES PATENT AND TRADEMARK OFFICE

CERTIFICATE OF CORRECTION

PATENT NO. : 6,079,666
APPLICATION NO. : 06/859033
DATED : June 27, 2000
INVENTOR(S) : Alton B. Hornback It is certified that error appears in the above-identified patent and that said Letters Patent is hereby corrected as shown below:

In the specification, column 2, line 2, "statistic" should read -- statistics --;

Column 3, line 7, "(e)" should read -- (d) --;

Column 3, line 9, "(f)" should read -- (e) --;

Column 4, line 12, cancel the text, "Re";

Column 4, line 14, " $\left[\frac{\Delta}{\Sigma}\right]$. " should read -- Re $\left[\frac{\Delta}{\Sigma}\right]$. --;

Column 4, line 30, cancel the text, "Re";

Column 4, line 32, " $\left[\frac{\Delta}{\Sigma}\right]$ " should read -- Re $\left[\frac{\Delta}{\Sigma}\right]$ --;

Column 4, line 55, "6(LOS)" should read -- $\delta$(LOS) --;

Column 5, lines 12, 49, and 63, for each occurrence, "$\delta$(LOS$\gamma\Delta\theta$)" should read -- $\delta$(LOS$\pm\Delta\theta$) --;

Column 5, line 22, after "$V_m$", insert -- = -- and "$V_{DR}$(LOS$\Delta\theta$)" should read -- $V_{DR}$(LOS-$\Delta\theta$) --;

Column 5, line 64, "$V_D$(LOS$\gamma\Delta\theta$)" should read -- $V_D$(LOS$\pm\Delta\theta$) --;

Column 5, line 68, after "$V_{AGC}$" insert -- = -- and "$V_{DR}$(LOS+$\Delta\theta$)" should read -- $V_{DR}$(LOS$\pm\Delta\theta$) --;

Column 6, line 30, " $\dot{\theta}$ " should read -- $\dot{\beta}$ --;

Column 6, line 40, "T" should read -- $\tau$ --; and

Column 6, line 54, cancel the text, "RE";

Column 6, line 57, " $\left[\frac{\Delta}{\Sigma}\right]$ " should read -- Re $\left[\frac{\Delta}{\Sigma}\right]$ Ratio detector output --; and

UNITED STATES PATENT AND TRADEMARK OFFICE

CERTIFICATE OF CORRECTION

PATENT NO. : 6,079,666
APPLICATION NO. : 06/859033
DATED : June 27, 2000
INVENTOR(S) : Alton B. Hornback It is certified that error appears in the above-identified patent and that said Letters Patent is hereby corrected as shown below:

Column 6, line 60, cancel the text, "Ratio detector output".

Signed and Sealed this

Twenty-ninth Day of January, 2008

JON W. DUDAS
*Director of the United States Patent and Trademark Office*